United States Patent [19]

Darrichard et al.

[11] 4,433,535

[45] Feb. 28, 1984

[54] GLASS FIBRE YARNS AND OTHER GOODS, AND METHOD OF MANUFACTURE

[75] Inventors: Louis D. Darrichard, Conde sur Noireau; Jacques Plaisant, Flers, both of France

[73] Assignee: Valeo, Paris, France

[21] Appl. No.: 335,328

[22] Filed: Dec. 29, 1981

[30] Foreign Application Priority Data

Dec. 31, 1980 [FR] France ..... 80 27913

[51] Int. Cl.[3] ..... D02G 3/18; D02G 3/12

[52] U.S. Cl. ..... 57/229; 57/249; 57/252

[58] Field of Search ..... 57/229, 240, 249, 252, 57/255, 256

[56] References Cited

U.S. PATENT DOCUMENTS

| | | | |
|---|---|---|---|
| 2,120,270 | 6/1938 | Tucker | 57/229 X |
| 2,306,781 | 12/1942 | Francis | 57/255 X |
| 3,007,227 | 11/1961 | Moler | 57/255 X |
| 3,359,717 | 12/1967 | Marzocchi | 57/256 |
| 3,648,451 | 3/1972 | Riley | 57/255 |
| 3,669,173 | 6/1972 | Young | 57/249 X |
| 3,866,405 | 2/1975 | Knopka | 57/255 |
| 3,913,309 | 10/1975 | Chiarotto | 57/229 |
| 4,001,477 | 1/1977 | Economy et al. | 57/255 |
| 4,331,729 | 5/1982 | Weber | 57/904 |

*Primary Examiner*—Donald Watkins

*Attorney, Agent, or Firm*—Dennison, Meserole, Pollack & Scheiner

[57] ABSTRACT

A yarn is made by carding short lengths of glass fibre and then spinning the carded fibres. Advantageously short lengths of support fibre are mixed in with the short lengths of glass fibre before carding. A reinforcing strand may be buried in the yarn during spinning or during a subsequent twisting step. The support fibre should preferably be flexible. The resulting yarn, or goods made therefrom, can be used in many applications to replace goods based on asbestos fibres or on continuous glass fibres.

13 Claims, No Drawings

GLASS FIBRE YARNS AND OTHER GOODS, AND METHOD OF MANUFACTURE

The present invention relates to yarns made mainly from glass fibre, to a method of manufacturing such yarns, and to goods made from the yarns.

BACKGROUND OF THE INVENTION

A wide range of goods are made using asbestos fibres, but it is well known that asbestos fibres are particularly damaging to the health of people working on such production lines. For this reason, various attempts have been made to replace asbestos fibres with less dangerous substances such as ceramic fibres, rock fibres, carbon fibres, glass fibres, synthetic fibres, etc.

Particular attention has been paid to continuous glass fibre yarns made up from individual filaments of great length and of fineness lying between 4 microns and 20 microns. These filaments can simply be twisted together to obtain a plain or twisted yarn, useable in the manufacture of cloth, braid, cord, etc. The resulting goods are nevertheless of inferior quality when compared with goods based on asbestos fibres, and they cannot compete with them effectively.

Attention has also been paid to ceramic fibres and to carbon fibres, but using such fibres increases costs very greatly.

Up to the present, no material has been found which is less dangerous than asbestos fibre, but which has comparable or superior mechanical and physical properties, while not increasing costs.

Proper application of the present invention goes at least some of the way to meeting the above requirements.

SUMMARY OF THE INVENTION

The present invention provides a textile yarn comprising short lengths of glass fibre which are carded and then spun.

It has been observed that the mechanical and physical properties of goods made from glass fibre yarns are greatly improved when yarns made from continuous glass fibres are replaced by yarns made by carding and spinning short glass fibres. A priori, this result is surprising. Short glass fibres are not presently available on the market, and they have had to be made by breaking up or cutting up continuous glass fibres.

Advantageously, the yarn in accordance with the invention comprises a mixture of said short glass fibres mixed with support fibres such as acrylic fibres, modacrylic fibres, polyamides, polyesters, acrylonitriles, cotton, wool, fibres, etc.

Yarns are thus obtained with properties of great flexibility and high mechanical strength that are comparable with, or even superior to, the equivalent properties of asbestos yarns.

The present invention also provides a method of making such yarns, comprising the steps of mixing support fibres and short glass fibres, of carding the mixture, and then of spinning it. The resulting yarn may be provided with a reinforcing core filament, either by twisting or by spinning. Advantageously, the support fibres are flexible fibres.

The invention further provides glass fibre articles or goods made by weaving, braiding or twisting yarns according to the invention.

MORE DETAILED DESCRIPTION

In one advantageous implementation of the invention, E, C, A, R or S glass fibre obtained by the "SILIONE" or the "VERRANE" processes is used. The fibre fineness is generally in the range from about 4 microns to about 20 microns, and the fibre is in lengths lying in the range from about 10 mm (millimeters) to about 100 mm. The short fibres are obtained by breaking, cracking, or cutting up lengths of continuous glass fibre made in the conventional manner by glass manufacturers.

It is preferable to use fibres that have been oiled during manufacture, either with a textile oil (comprising a binder such as a starch derivative, and a lubricant such as a vegetable oil), or else with a plastic oil comprising a binder, a lubricant and a chemical bridging agent. Wetting agents and anti-static agents may also be included in the oils used.

The short glass fibres are mixed with support fibres that are preferably flexible. The fineness of the support fibres is generally in the range from 1.4 to 15 decitex, and the length is in the range from about 10 mm to about 100 mm. The support fibres may be of various different kinds: viscose staple fibre, acrylic or modacrylic fibre, polyamide fibre, polyester fibre, fireproofed viscose staple fibre, fire-proofed acrylonitrile fibre, cotton, wool, etc.

In the mixture, the proportion of support fibre is advantageously in the range 5% to 50% by weight, while the propotion of glass fibre lies correspondingly in the range 95% to 50% by weight.

Manufacturing comprises the following steps:

"Opening", in which balls of raw material (balls of glass fibre or of support fibre) are unpacked and loosened to separate the fibres from one another;

"Mixing", in which the different components (glass fibres and support fibres) are mixed together;

"Carding", in which the mixture is carded on a "spinning carder", i.e. a carding machine supplying roving from the carding web by dividing the web into strips using a set of straps and dividing cylinders, with each of the strips being agglomerated by a friction device, and then winding the stip of roving onto a bobbin; and "Spinning", in which the mixture is spun and twisted on a continuous ring spinner of conventional type.

The yarn thus obtained is then woven, braided or twisted depending on the type of product required, (cloth, braid or cord).

For some applications it is necessary during spinning to incorporate a reinforcing strand in the yarn of carded fibres. The reinforcing or core strand may, for example, be a filament of the alloy known under the name INCONEL, or of copper or brass or steel, or it may be a carbon, a synthetic, an aryl amide or aramide fibre, etc. The reinforcing strand is completely surrounded or covered by the glass fibres and the support fibres during spinning or twisting.

In conventional processes using continuous fibres, a reinforcing fibre has to be wrapped or lapped, whereas in the present process the reinforcing fibre is simply buried in the fibers during spinning.

Fibre glass yarn in accordance with the invention, and articles made therefrom, have numerous advantages compared with similar yarn and articles based on asbestos fibres or other fibres such as ceramic fibres or rock fibres:

They cost considerably less;

They withstand high temperatures well;

Since the fineness of the glass fibres used in their fabrication lies preferably in the range 4 microns to 20 microns, they are less dangerous to the health of people working on production lines (safety can be further improved by using moisturising and dust controlling means on said production lines in a manner similar to that used for asbestos production);

They are more flexible and they expand more than the others (based on asbestos, continuous glass fibres or ceramic fibres);

Their mechanical properties (resistance to tearing, and to repeated mechanical stresses) are much better than competitive products; and They are better thermal insulators than asbestos based products, being equivalent to products based on continuous glass fibres or ceramic fibres.

These advantages can be clearly seen from the accompanying table which shows the results of comparative tests carried out on products: (1) based on asbestos; (2) based on yarn in accordance with the invention; (3) based on ceramic fibres; and (4) based on continuous glass fibres.

Product number (1) comprises 85% chrysotile (asbestos) fibres of less than 3 microns diameter, together with 15% support fibres.

Product number (2) in accordance with the invention comprises 75% E glass fibres of 10 to 15 microns diameter, together with 25% flameproof support fibres.

Product number (3) comprises 70% ceramic fibres with a diameter of about 3 microns, together with 30% support fibres.

Product number (4) comprises continuous glass fibres on their own, with a diameter of about 10 to 15 microns.

The high temperature performance is tested by testing the mechanical strength of the product after heating to the indicated temperature for two hours.

The abrasion performance is given in hours survival time to an official test approved by the French authorities.

TABLE

| | Product No | | | |
|---|---|---|---|---|
| | 1 | 2 | 3 | 4 |
| High temperature performance | acceptable up to 450–500° C. | acceptable up to 400–450° C. | acceptable up to 800° C. (using an Inconel strand) | acceptable up to 400–450° C. |
| Abrasion resistance (in hours) | 1200 g/m$^2$ cloth = 8 hours | 1200g/m$^2$ cloth = 26 hours | cloth = negligeable | 1000g/m$^2$ cloth = 6 hours |
| Tensile strength in kilograms force (50 mm width of 1200g/m$^2$ cloth) | Warp = 120 kgf<br>Weft = 69 kgf | Warp = 167 kgf<br>Weft = 96 kgf | Warp = 70 kgf<br>Weft = 30 kgf | |
| Coefficient of thermal conductivity. (kilocalorie/meter/°C./hour) | 1200g/m$^2$ cloth = 0.075<br>650g/m$^2$cloth = 0.084 | 1200g/m$^2$ cloth = 0.042 | 1200g/m$^2$ cloth = 0.061 | 1000g/m$^2$cloth = 0.039 |
| Resistance to acids | poor | good | poor | good |
| Resistance to bases | good | good | poor to strong bases | good |
| Relative density in comparison with product No 1. | 1 | 0.60 | 0.70 | |

We claim:

1. A textile yarn, comprising a mixture of short glass fibres and short support fibres which are carded and then spun, the diameter of said glass fibres being from about 4 microns to about 20 microns, and the fineness of the support fibres being from about 1.4 decitex to about 15 decitex.

2. A yarn according to claim 1, wherein the length of the glass fibres is from about 10 mm to about 100 mm.

3. A yarn according to claim 1, wherein the mixture comprises 50% to 95% by weight glass fibres and 50% to 5% by weight support fibres.

4. A yarn according to claim 1, wherein the support fibres are flexible fibres.

5. A yarn according to claim 1, wherein the flexible support fibres are chosen from the group comprising viscose staple fibre, fire-proofed viscose staple fibre, acrylics, modacrylics, polyamides, polyesters, fire-proofed acrylonitriles, cotton, and wool fibres.

6. A yarn according to claim 1, wherein the length of the support fibres is from about 10 mm to about 100 mm.

7. A yarn according to claim 1, wherein the yarn includes a reinforcing strand buried in the yarn by spinning or twisting.

8. A yarn according to claim 7, wherein the reinforcing strand is chosen from the group comprising metal filaments, carbon fibres, and synthetic fibres.

9. A fibre glass based article made from the yarn of claim 1 by weaving, braiding or twisting.

10. A method of manufacturing a yarn according to claim 1, comprising the steps of mixing short glass fibres with short support fibres, of carding the mixture, and then of spinning it.

11. A method according to claim 1, wherein a reinforcing filament is incorporated in the yarn during spinning.

12. A method according to claim 1, wherein a reinforcing filament is incorporated in the yarn during a subsequent twisting step.

13. A method according to claim 11, including an initial step of reducing continuous glass fibres to form said short lengths of glass fibre, said step of reducing the fibre being performed by breaking or cutting.

* * * * *